US005603436A

United States Patent [19]

Leoncavallo et al.

[11] Patent Number: 5,603,436

[45] Date of Patent: Feb. 18, 1997

[54] SQUEEZE BOTTLE AND LEAKPROOF CLOSURE DEVICE

[75] Inventors: Richard A. Leoncavallo, Pittsford; Peter K. Baird, Honeoye Falls; Mark Giverc, Canandaigua; Ravi Mehra, Fairport, all of N.Y.

[73] Assignee: Nalge Company, Rochester, N.Y.

[21] Appl. No.: 372,063

[22] Filed: Jan. 12, 1995

[51] Int. Cl.[6] ..... B67D 3/00

[52] U.S. Cl. ..... 222/525; 222/545; 222/212

[58] Field of Search ..... 222/212, 523, 222/525, 545

[56] References Cited

U.S. PATENT DOCUMENTS

| | | | |
|---|---|---|---|
| 25,853 | 10/1859 | Stickney . | |
| 1,958,429 | 5/1934 | Hartog . | |
| 2,358,228 | 9/1944 | Hoof . | |
| 2,490,511 | 12/1949 | Courtot . | |
| 2,506,722 | 5/1950 | Kuehn et al. . | |
| 2,591,514 | 4/1952 | Courtot . | |
| 2,701,579 | 2/1955 | Hasselquist . | |
| 2,713,989 | 7/1955 | Bryant . | |
| 2,969,168 | 1/1961 | Newby . | |
| 2,998,902 | 9/1961 | Thomas et al. . | |
| 3,012,698 | 12/1961 | Wiederquist et al. . | |
| 3,032,240 | 5/1962 | Dunklee . | |
| 3,120,910 | 2/1964 | Nyden . | |
| 3,157,323 | 11/1964 | Kitterman . | |
| 3,198,481 | 8/1965 | Byrant . | |
| 3,227,332 | 1/1966 | Gowdy et al. . | |
| 3,326,426 | 6/1967 | Porter et al. . | |
| 3,342,384 | 9/1967 | Jacobs . | |
| 3,390,821 | 7/1968 | Mullan . | |
| 3,395,835 | 8/1968 | Tarran . | |
| 3,521,796 | 7/1970 | Roy | 222/525 |
| 3,572,559 | 3/1971 | Stull . | |
| 3,735,777 | 5/1973 | Katzer et al. . | |
| 3,738,545 | 6/1973 | Roy . | |
| 4,020,981 | 5/1977 | Nixdorff . | |
| 4,629,098 | 12/1986 | Eger . | |
| 4,718,442 | 1/1988 | Nicoll . | |
| 4,742,851 | 5/1988 | Lundblade . | |
| 4,771,919 | 9/1988 | Ernst . | |
| 4,813,577 | 3/1989 | Carow . | |
| 4,817,831 | 4/1989 | Theisen . | |
| 5,094,363 | 3/1992 | Monahan et al. . | |
| 5,100,033 | 3/1992 | Cho . | |
| 5,137,183 | 8/1992 | Mikulec et al. . | |
| 5,145,094 | 9/1992 | Perlmutter . | |
| 5,285,933 | 2/1994 | Gentes et al. | 222/525 X |

FOREIGN PATENT DOCUMENTS

| | | |
|---|---|---|
| 493228 | 4/1954 | Italy . |
| 172078 | 7/1988 | Japan . |

*Primary Examiner*—Gregory L. Huson
*Attorney, Agent, or Firm*—Wood, Herron & Evans, P.L.L.

[57] ABSTRACT

A dispensing container including a receptacle portion for holding liquids and an upper opening having a closure device. The closure device is embodied in threaded cap which closes a relatively large opening in the top of the receptacle portion for filling purposes. The closure device includes a spout connected to the threaded cap for sliding movement between open and closed positions. The spout includes a plug member having a resilient static sealing element. A tubular closure element is secured to the threaded cap and includes a plug bore which receives the plug member and further defines a fluid flow path. A resilient dynamic sealing element is disposed on an outer surface of the tubular closure element and the dynamic sealing element is in continuous contact with an inner surface of the spout during sliding movement thereof. The tubular closure element further includes an upper sealing surface adapted to engage the static sealing element and apply axial compression thereto when the spout is in a closed position. A flip-top protective cover is connected to the threaded cap and, in a closed position, the protective cover maintains the static sealing element in axial compression against the sealing surface.

41 Claims, 3 Drawing Sheets

SQUEEZE BOTTLE AND LEAKPROOF CLOSURE DEVICE

BACKGROUND OF THE INVENTION

The present invention generally relates to the field of dispensing receptacles and, more particularly, to a squeeze bottle for use as outdoor and cycling equipment and including a leakproof push/pull closure device.

In outdoor activities, it is often desirable to use squeeze bottles or other containers having fast acting push/pull type spouts or closure devices. For example, a bicyclist often requires the use of such a squeeze bottle which is usually attached to the bicycle frame. Push/pull closure devices allow the liquid within the container to be easily dispensed through a squeezing action thereof and further allow the closure device to be easily opened and closed by the user.

Many of these push/pull type dispensing closures involve the use of a stem portion which is surrounded by a slidable or movable spout portion wherein the spout portion may be pulled in an upward direction to open the closure and pushed in a downward direction to close the closure. The stem portion blocks an opening in the spout when the spout is in a down position and backs away from the opening in the spout when the spout is in an up position. Typically, a seal is created between an upper portion of the stem and the opening in the spout. This "static seal" prevents leakage from the container while the spout is in a closed position. Furthermore, many of these push/pull type closure devices include a "dynamic seal" which provides a constant sliding seal between the stationary stem portion and the sliding or movable portion. The main function of this seal is to ensure that all of the liquid flows properly through the spout and out of the outlet end thereof without any leakage occurring between the spout and the stem while dispensing liquid. Some examples of this general type of push/pull closure device are found in U.S. Pat. Nos. 2,969,168; 2,998,902; 3,012,698; 3,120,910 and 3,227,332. Further examples of push/pull type closure devices are found in U.S. Pat. Nos. 3,738,545; 5,094,363; and 5,100,033.

Push/pull type closure devices of the past have certain drawbacks and disadvantages. Many of these past designs do not, for example, provide adequate leak protection for the container. Such leak protection is especially important in outdoor activities such as camping in which a variety of liquids are kept in containers having push/pull type closure devices. This is because all of these containers are kept in a single backpack or other bag during travel and any leakage would cause a mess within the backpack or bag. Often, these dispensing closures leak due to the inherent inability to maintain the close tolerances necessary between the sliding parts and sealing parts of the closure. Whether these tolerances are breached before use or after use, the result is a closure that leaks.

One push/pull type closure device and squeeze bottle currently on the market utilizes a double O-ring sealing system for the closure device wherein both the dynamic seal and the static seal are formed by O-rings disposed on the stem portion of the closure device. The lower, dynamic seal is disposed between the spout and the stem portion of the closure while the upper, static seal is disposed around an upper portion of the stem and seals with the opening of the spout when the spout is in a closed position. Although such use of O-rings helps to alleviate the problems associated with maintaining the close tolerances necessary to prevent leakage, the upper O-ring in this arrangement is in radial compression as are the static sealing elements used in other past push/pull closure devices. One of the problems with maintaining radial compression on a static sealing element is that the compression cannot be easily adjusted if leakage does occur. For example, pushing down on the spout harder will generally not cause a tighter seal when the seal relies on radial compression.

SUMMARY OF THE INVENTION

It has therefore been one objective of the invention to provide a push/pull type closure device for a dispensing receptacle wherein the spout portion of the closure device is easily manipulated back and forth yet provides better and more consistent leakage protection than heretofore possible.

It has been another objective of this invention to provide a dispensing receptacle incorporating the improved push/pull type closure device of the invention.

It has been yet another objective of the invention to provide a closure device having a resilient static sealing element in axial compression to better maintain a seal when the closure device is in a closed position.

It has been still a further objective of the invention to provide a protective cover on the top of the receptacle which maintains the static sealing element in axial compression to further insure against leakage when the closure device is in a closed position.

To these ends, the present invention comprises a dispensing container including a receptacle portion for holding liquids and an upper opening having a closure device constructed to meet the above objectives. Specifically, the closure device is embodied in a threaded cap which closes the relatively large fill opening in the top of the receptacle. The closure device includes a spout connected to the threaded cap so as to be slidable between open and closed positions. The spout further includes a plug member having an annular, resilient static sealing ring or element disposed on an outside surface thereof. The tubular closure element is secured to the threaded cap and includes a plug bore which receives the plug member and which further defines a fluid flow path out of the receptacle. An annular resilient dynamic sealing ring is disposed on an outer surface of the tubular closure element and is in continuous contact with an inner surface of the spout during sliding movement thereof between open and closed positions. The tubular closure element further includes an upper sealing surface adapted to engage the static sealing element and apply axial compression thereto when the spout is in a closed position.

To assure that the static sealing element is retained against the sealing surface in compression, the spout and tubular closure element have mating interference structure which engages to assist in maintaining the spout in a closed and sealed position. Adjacent portions of the spout and cap may also have, or alternatively have, such mating interference structure for maintaining the spout in a closed and sealed condition. For further compression of the static sealing element, and therefore even more effective sealing, a compressing member preferably in the form of a flip top protective cover is connected to the threaded cap. When the cover is in a closed position, the cover bears against the spout and maintains the static sealing element in axial compression against the sealing surface of the tubular closure element.

Both the static sealing element and the dynamic sealing element preferably comprise resilient O-rings which are respectively held in tension about the plug member and the spout. The plug member extends downwardly into the bore of the tubular closure element and includes an upper cylindrical portion which receives the static sealing O-ring. A plurality of guide members extend downwardly from the upper cylindrical portion and includes slightly tapered side edges. The guide members allow liquid in the receptacle to flow through the bore in the tubular closure element when the spout is in an open position. The plug member is further centrally located within an upper opening of the spout and is secured thereto by a plurality of radially extending web members. The areas between the web members define fluid flow passages for allowing liquid to be discharged from the spout.

The present invention thus provides a receptacle and, more specifically, a closure device for a dispensing receptacle which is easily moved into open and closed positions and provides improved leakage protection in the closed position when compared to past designs. Moreover, leakage protection is far easier to maintain since the static sealing element of the closure device is placed in axial compression as opposed to radial or lateral compression. Thus, costs and complexity of the device are reduced since extremely close tolerances need not be maintained with respect to the sealing elements and surfaces of the device.

These and other objectives and advantages of the invention will become more readily apparent to those of ordinary skill in the art upon review of the following detailed description of the invention taken in conjunction with the accompanying drawings.

DETAILED OF THE PREFERRED EMBODIMENT

Figure 1:
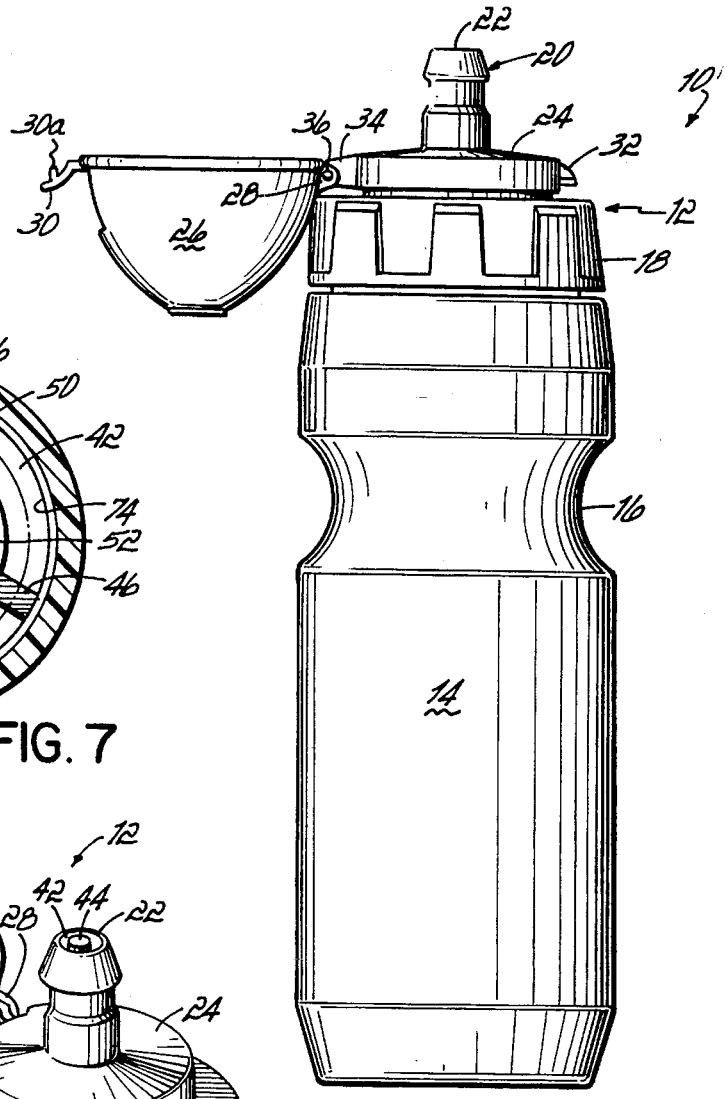
FIG. 1 is an elevational view of a dispensing container constructed in accordance with the invention.
Figure 2:
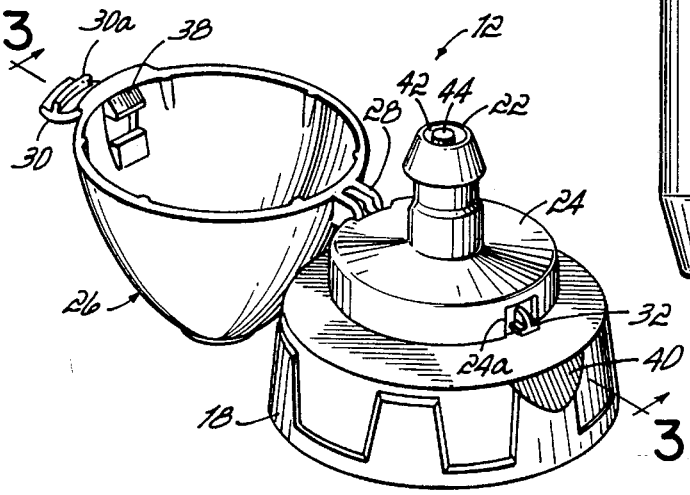
FIG. 2 is a perspective view illustrating the closure device, including the cap and protective cover, of FIG. 1.

Referring first to FIG. 1, a dispensing container 10 is shown and generally includes an upper closure device 12 for closing the upper opening of a lower receptacle portion 14 used for containing liquids. Lower receptacle portion 14 includes an annular recessed grip 16 as is conventional. Closure device 12 comprises a screw-on cap 18 and a spout 20 connected to cap 18 with a push/pull connection which allows spout 20 to be moved with respect to cap 18 between open and closed positions as will be described below. Spout 20 includes a liquid discharge end 22 and an enlarged base portion 24. Closure device 12 further includes a protective cover 26 having a hinge portion 28 and a finger tab 30 for enabling a user to lift protective cover 26 off of snap lock portion 32 of cap 18 in a manner to be described below. Snap lock portion 32 extends from an upper portion of cap 18 through a slot 24*a* in base portion 24 (FIG. 2). Hinge portion 28 of protective cover 26 connects with a hinge portion 34 extending from cap 18 by a pivot pin 36. Hinge portion 34 also extends through a slot (not shown) in base portion 24. Spout 20 and cover 26 are each formed from a relatively hard plastic material, such as polycarbonate.

Figure 6:
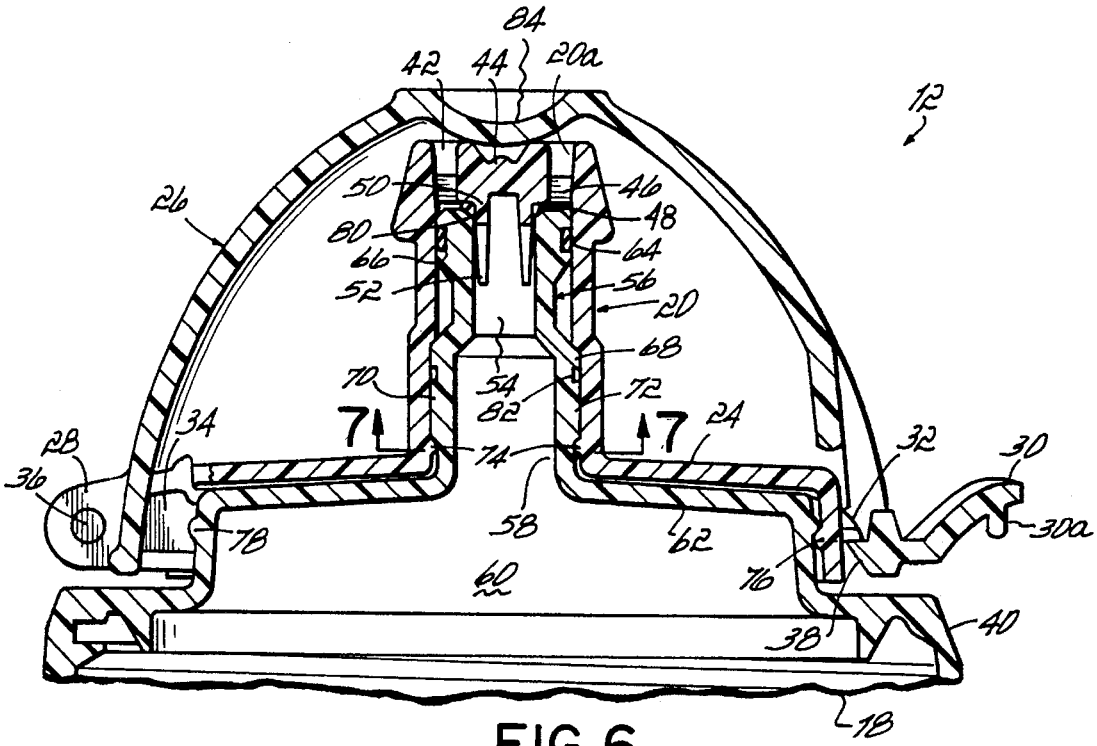
FIG. 6 is a cross sectional view similar to FIG. 3 but showing the protective cover in a closed position with a portion thereof bearing on the top of the spout portion.

As best shown in FIGS. 2 and 6, protective cover 26 may be pivoted over top of cap 18 and snap locking latch portion 38 located inside protective cover 26 may be received with a snap fit beneath snap locking portion 32 of cap 18. As also shown in FIGS. 2 and 6, cap 18 includes an inwardly angled surface 40 for more easily allowing a user's finger to slide beneath finger tab 30. Finger tab 30 further includes a lower projection 30*a* for allowing the user's finger to easily grip finger tab 30 and lift upwardly.

Figure 7:
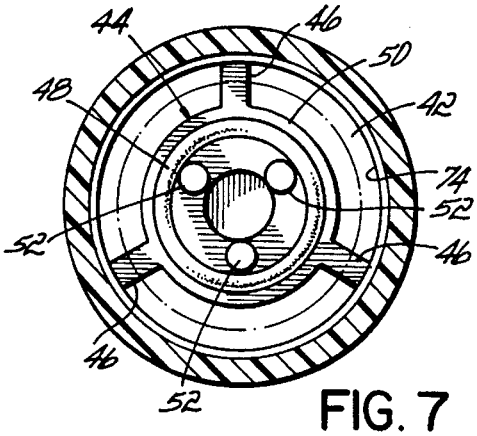
FIG. 7 is a cross sectional view of the closure device taken along line 7—7 of FIG. 6; and, FIG. 8 is a fragmented view of the closure device showing the closure element thereof in solid lines and the spout portion in phantom lines.
Figure 3:
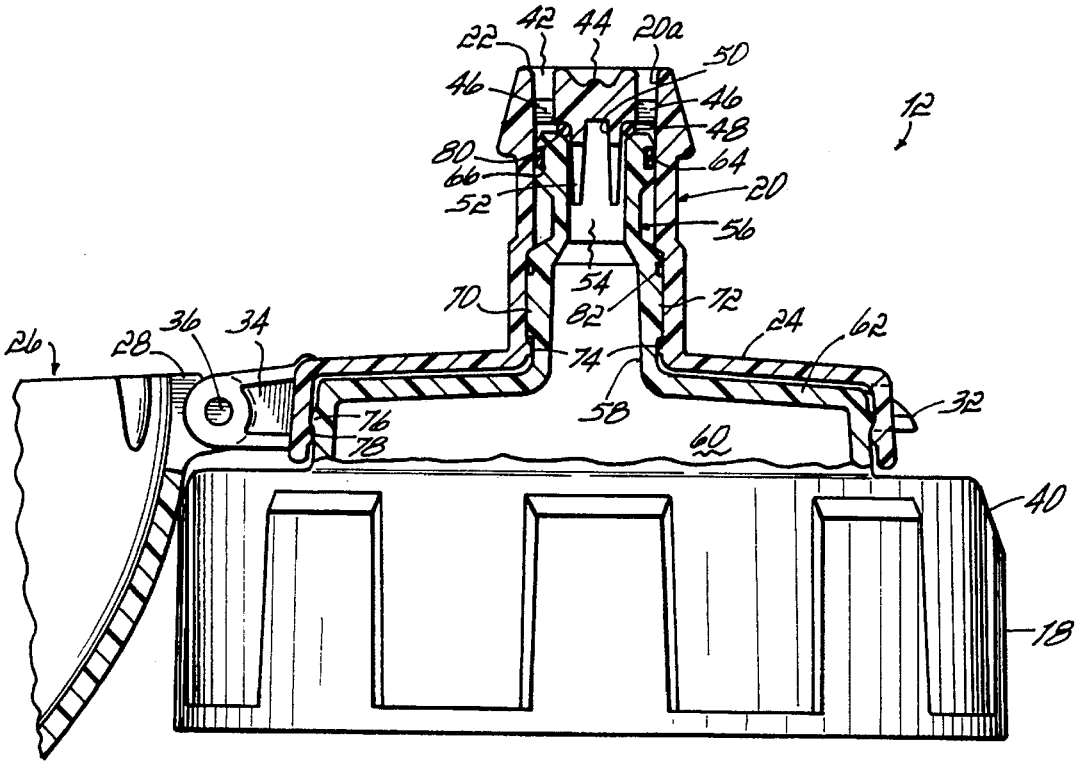
FIG. 3 is a cross sectional view taken along line 3—3 of FIG. 2 showing the spout portion of the closure device in a lowered or closed position.
Figures 4, 5A, 5B:
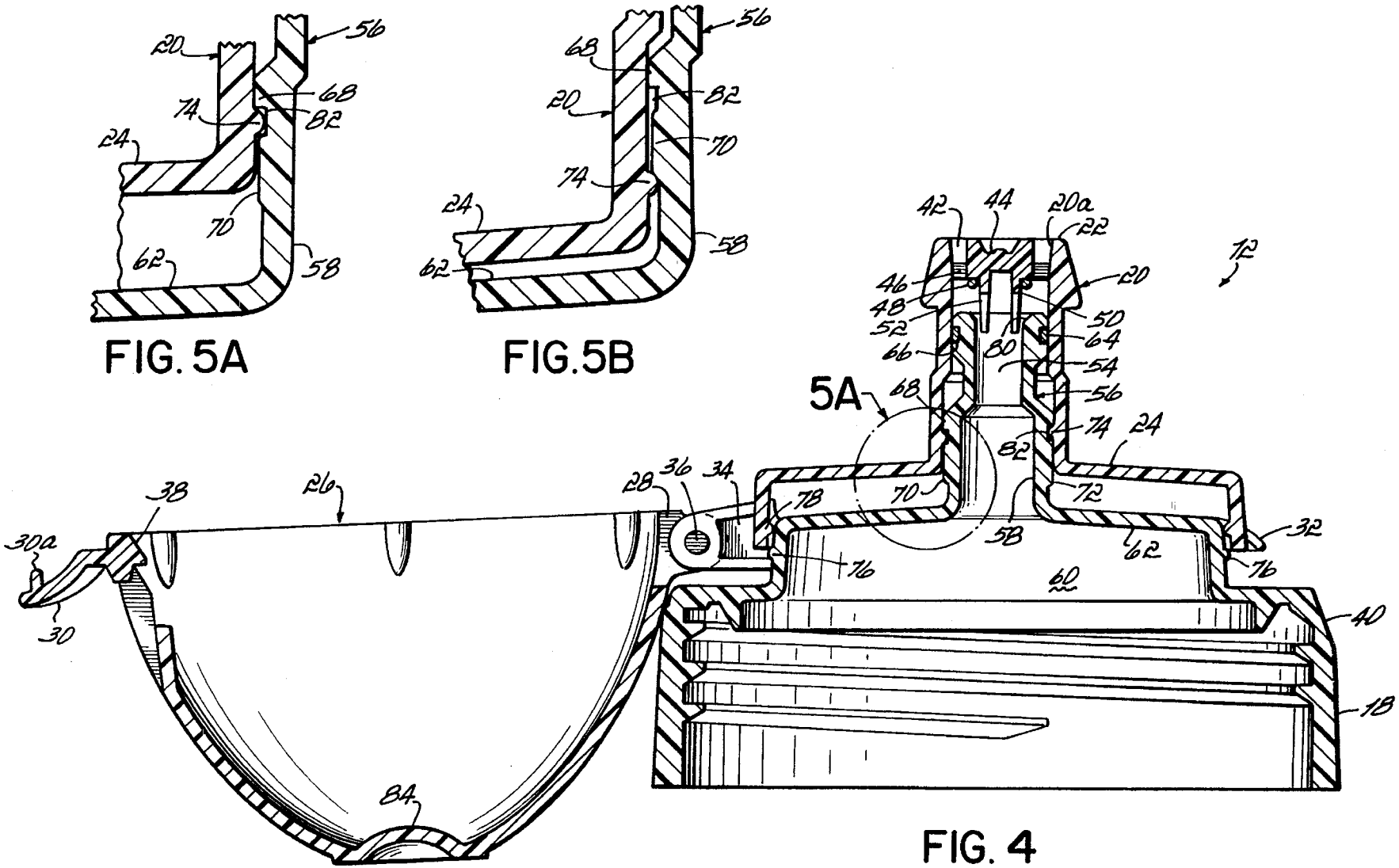
FIG. 4 is a cross sectional view similar to FIG. 3 but showing the spout portion of the closure device in a raised or open position.
FIG. 5A is an enlarged view of the encircled portion 5A of FIG. 4 showing the spout portion of the closure device in a raised or open position.
FIG. 5B is an enlarged view similar to FIG. 5A but showing the spout portion in a lowered or closed position.

Referring now to FIGS. 3, 4 and 7, spout 20 includes an upper outlet opening 42 which defines a portion of the flow path out of receptacle 14 and closure device 12. A plug member 44 is rigidly secured centrally within opening 42 by a plurality of web members 46 extending between plug member 44 and an inner wall 20*a* of spout 20. Spout 20 further includes a resilient static sealing element, such as an O-ring 48 held in tension about a cylindrical portion 50 of plug member 44. A plurality of guide members or vanes 52 extend downwardly from cylindrical portion 50 and are received in a plug bore 54 of a tubular closure element 56. Guide members 52 taper inwardly toward their lower ends to allow seal or O-ring 48 to be easily installed and placed in tension onto cylindrical portion 50. Plug bore 54 forms part of a liquid flow path between tubular closure element 56. Tubular closure element 56 is formed as a rigid, integral part of cap 18 preferably by molding the entire structure from a relatively soft plastic material such as low density polypropylene or a copolymer of polypropylene and ethylene.

Still referring mainly to FIGS. 3 and 4, closure element 56 includes an inner flow passage 58 which communicates with outlet opening 42 of spout 20. Internal flow passage 58 further communicates with an internal space 60 of cap 18. Closure element 56 extends upwardly from a circular extension 62 of cap 18 and receives spout 20 with a sliding fit. Circular extension 62 also receives base portion 24 of spout 20 thereon with a sliding, push/pull motion as will be described below. Closure element 56 further includes an outer resilient sealing element, such as an O-ring 64 which is held in tension within a recess 66 disposed about an upper end of closure element 56. It will be appreciated as spout 20 is pushed and pulled or, in other words, slide upwardly and downwardly about closure element 56, O-ring 64 provides a dynamic liquid seal against inner wall 20*a* of spout 20. This prevents leakage of liquid between closure element 56 and spout 20 during use.

A appreciated from FIGS. 3 and 4, but perhaps better from FIGS. 5A and 5B, the push/pull movement of spout 20 is limited by structure including an annular flange portion 68 on closure element 56, two pairs of vertical projections 70, 72 extending from diametrically opposite sides of closure element 56 and an annular projection 74 extending inwardly from a lower inner portion of spout 20. As will further be appreciated from FIGS. 3 and 4, an inner annular projection 76 may be provided on base portion 24 of spout 20 and a mating outer annular projection 78 may be provided on extension portion 62 of cap 18. This provides a further mechanism for retaining spout 20 in a lowered position at which resilient sealing element 48 is compressed against upwardly facing seal surface 80 of closure element 56. The main structure for accomplishing this compression of static sealing element 48, however, is provided by engagement of annular projection 74 with lower ends of the respective vertical projections 70, 72 as shown in FIG. 3. In this regard, it is easier to maintain the necessary tolerances between the parts at the lower diameters of the spout 20 and closure element 56.

Figure 8:
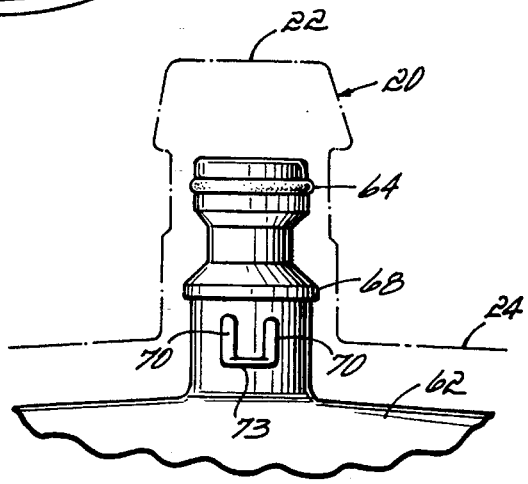

Referring specifically to FIGS. 5A, 5B and 8, it will be understood that at the upper or open position of spout 20, annular projection 74 is contained within a space 82 beneath flange portion 68 and is thereby prevented from being easily removed from closure element 56 and cap 18. On the other hand, when spout 20 is pushed to its downward or closed position as shown in FIG. 3 with the static sealing element 48 engaged with sealing surface 80, the lower ends of each pair of vertical projections 70 disposed on the outside surface of closure element 56 retain spout 20 in a lower, closed position with static sealing element or O-ring 48 held in compression against sealing surface 80 (FIG. 3). To aid in retaining spout 20 and, more particularly, annular projection 74 beneath vertical projections 70, 72, each pair of vertical projections 70, 72 includes a lower horizontal projection 73 connecting their lower ends (FIG. 8).

Referring specifically to FIG. 6, in addition to its protective aspects, protective cover 26 further acts as a compressing member for supplying additional compression to static sealing element 48. In this regard, an inner surface comprising an inwardly extending dimple 84 on top of cover 26 bears against plug member 44 and applies a downward force thereon when snap lock portions 32, 38 respectively disposed on cap 18 and protective cover 26 are in engagement as shown. In addition to projections 70, 72, 73, which retain spout 20 in a lower, closed and sealed position, this provides an even further assurance against leakage past static sealing element 48 since it provides an even tighter seal between O-ring 48 and seal surface 80.

In operation, and referring first to FIG. 1, cap 18 may be unscrewed from receptacle portion 14 and container 10 may be filled with the desired liquid or beverage. During storage and transportation with liquid contained in receptacle portion 14, spout 20 is pushed down onto cap 18 and cover 26 is flipped onto cap 18 and snapped closed as shown in FIG. 6. As will further be appreciated from FIG. 6, this will push guide member portions 52 as well as a lower part of cylindrical portion 50 of plug member 44 into bore 54. Annular projection 74 will move downwardly over vertical projections 70, 72 and be retained beneath them as shown supplying compression to static sealing element 48 against sealing surface 80 of tubular closure element 56. Dimple 84 provides even further downward force against spout 20 to further compress seal 48 against surface 80.

When it is desired to drink or dispense from container 10, cover 26 is flipped open by lifting tab 30 with a finger and spout 20 is lifted upwardly, either by the user's other hand or by the user grasping spout 20 by his or her teeth to lift seal 48 upwardly off surface 80 as shown in FIG. 4. This provides a continuous liquid flow path from receptacle portion 14 (FIG. 1) through space 60 of cap 18, passages 58 and 54 of closure element 56, between guide members 52 and web members 46 and finally through outlet opening 42 of spout 20.

From the foregoing description, it will be appreciated that the present invention provides a dispensing receptacle which may be formed relatively inexpensively and yet which provides very effective leakage protection and is easily operated by the user, such as a biker rider, with only one available hand.

While a detailed description of the invention has been given herein in the form of a representative preferred embodiment, it is not Applicant's intent to be bound by the details of this embodiment but only to be bound by the scope of the appended claims.

What is claimed is:

1. A dispensing container comprising:

a) a receptacle;

b) a closure device for closing an upper opening of said receptacle, said closure device including, i) a cap;

ii) a tubular closure element connected to said cap and including a bore defining a portion of a flow path through said cap, a generally upwardly facing sealing surface disposed about said bore, and a resilient dynamic sealing element disposed about an outer surface of said tubular closure element; and, iii) a spout having an outlet opening defining another portion of said flow path and being connected to said tubular closure element for sliding movement against said dynamic sealing element and along an axis between open and closed positions, said spout including a plug member disposed in said outlet opening and having an annular resilient static sealing element disposed thereon, wherein at least a portion of said plug member is receivable in said bore and said static sealing element is placed in axial compression against said sealing surface when said spout is in said closed position.

2. The dispensing container of claim 1 wherein said cap and said spout have mating interference structure for holding said spout in said closed position.

3. The dispensing container of claim 1 wherein said tubular closure element and said spout have mating interference structure for holding said spout in said closed position.

4. The dispensing container of claim 1 wherein said static sealing element comprises a removable O-ring held in tension around an outer surface of said plug member.

5. The dispensing container of claim 4 wherein said dynamic sealing element comprises a removable O-ring held in tension around an outer surface of said tubular closure element.

6. The dispensing container of claim 1 wherein said dynamic sealing element comprises a removable O-ring held in tension around an outer surface of said tubular closure element.

7. The dispensing container of claim 1 wherein said plug member further comprises a cylindrical upper portion which includes said static sealing element thereon and at least one guide member extending from said cylindrical upper portion, said guide member being at least partially receivable in said bore, wherein said guide member allows liquid in said receptacle portion to flow through said bore when said spout is in an open position.

8. The dispensing container of claim 7 wherein said plug member is rigidly secured within said outlet opening by web members extending between said plug member and an inner wall of said spout.

9. The dispensing container of claim 7 wherein said guide member tapers inwardly from a relative upper portion to a lower portion thereof.

10. The dispensing container of claim 9 further comprising a plurality of said guide members.

11. The dispensing container of claim 7 further comprising a plurality of said guide members.

12. A dispensing container comprising:

a) a receptacle;

b) a closure device for closing an upper opening of said receptacle, said closure device including, i) a cap;

ii) a tubular closure element connected to said cap and including a bore defining a portion of a flow path through said cap, a generally upwardly facing sealing surface disposed about said bore, and a resilient dynamic sealing element disposed about an outer surface of said tubular closure element; and, iii) a spout having an outlet opening defining another portion of said flow path and being connected to said tubular closure element for sliding movement against said dynamic sealing element and along an axis between open and closed positions, said spout including a plug member disposed in said outlet opening and having an annular resilient static sealing element disposed thereon, wherein at least a portion of said plug member is receivable in said bore and said static sealing element is placed in axial compression against said sealing surface when said spout is in said closed position; and, iv) a compressing member operatively connected to said cap and movable between positions engaged and disengaged with said spout, wherein said compressing member maintains said static sealing element in axial compression when said compressing member is in said engaged position.

13. The dispensing container of claim 12 wherein said cap and said spout have mating interference structure for holding said spout in said closed position.

14. The dispensing container of claim 12 wherein said tubular closure element and said spout have mating interference structure for holding said spout in said closed position.

15. The dispensing container of claim 12 wherein said compressing member is a protective cover having an inner surface which bears against said spout in said engaged position.

16. The dispensing container of claim 15 wherein said protective cover is hingedly connected to said cap and includes a snap closure element engageable with a snap closure element on said cap.

17. The dispensing container of claim 12 wherein said static sealing element comprises a removable O-ring held in tension around a portion of said spout.

18. The dispensing container of claim 17 wherein said dynamic sealing element comprises a removable O-ring held in tension around an outer surface of said tubular closure element.

19. The dispensing container of claim 12 wherein said dynamic sealing element comprises a removable O-ring held in tension around an outer surface of said tubular closure element.

20. The dispensing container of claim 12 wherein said plug member is centrally secured within said outlet opening and is receivable by said bore in said closure element, said plug member having a cylindrical upper portion on which said static sealing element is disposed.

21. The dispensing container of claim 20 wherein said plug member further includes at least one guide member extending from said cylindrical upper portion, said guide member being receivable in said bore of said closure element when said spout is in a closed position, said guide member allowing liquid in said receptacle portion to flow through said bore when said spout is in an open position.

22. The dispensing container of claim 21 wherein said plug member is rigidly secured within said outlet opening by web members extending between said plug member and an inner wall of said spout.

23. The dispensing container of claim 21 wherein said guide member tapers inwardly from a relative upper portion to a lower portion thereof.

24. The dispensing container of claim 23 further comprising a plurality of said guide members.

25. The dispensing container of claim 21 further comprising a plurality of said guide members.

26. A closure device for use on a dispensing receptacle, said closure device comprising:

i) a cap for closing an upper opening of said dispensing receptacle;

ii) a tubular closure element connected to said cap and including a bore defining a portion of a flow path through said cap, a generally upwardly facing sealing surface disposed about said bore, and a resilient dynamic sealing element disposed about an outer surface of said tubular closure element; and, iii) a spout having an outlet opening defining another portion of said flow path and being connected to said tubular closure element for sliding movement against said dynamic sealing element and along an axis between open and closed positions, said spout including a plug member disposed in said outlet opening and having an annular resilient static sealing element disposed thereon, wherein at least a portion of said plug member is receivable in said bore and said static sealing element is placed in axial compression against said sealing surface when said spout is in said closed position.

27. The dispensing container of claim 26 wherein said cap and said spout have mating interference structure for holding said spout in said closed position.

28. The dispensing container of claim 26 wherein said tubular closure element and said spout have mating interference structure for holding said spout in said closed position.

29. The closure device of claim 26 wherein said static sealing ring comprises a removable O-ring held in tension around an outer surface of said plug member.

30. The closure device of claim 29 wherein said dynamic sealing element comprises a removable O-ring held in tension around an outer surface of said tubular closure element.

31. The closure device of claim 26 wherein said dynamic sealing element comprises a removable O-ring held in tension around an outer surface of said tubular closure element.

32. The closure device of claim 26 wherein said plug member further comprises a cylindrical upper portion which includes said static sealing element thereon and at least one guide member extending from said cylindrical upper portion, said guide member and said cylindrical upper portion being receivable in said bore, wherein said guide member allows liquid in said receptacle portion to flow through said bore when said spout is in an open position.

33. A closure device for use on a dispensing receptacle, said closure device comprising:

i) a cap for closing an upper opening of said dispensing receptacle;

ii) a tubular closure element connected to said cap and including a bore defining a portion of a flow path through said cap, a generally upwardly facing sealing surface disposed about said bore, and a resilient dynamic sealing element disposed about an outer surface of said tubular closure element; and, iii) a spout having an outlet opening defining another portion of said flow path and being connected to said tubular closure element for sliding movement against said dynamic sealing element and along an axis between open and closed positions, said spout including a plug member disposed in said outlet opening and having an annular resilient static sealing element disposed thereon, wherein at least a portion of said plug member is receivable in said bore and said static sealing element is placed in axial compression against said sealing surface when said spout is in said closed position; and, iv) a compressing member operatively connected to said cap and movable between positions engaged and disengaged with said spout, wherein said compressing member maintains said static sealing element in axial compression when said compressing member is in said engaged position.

34. The dispensing container of claim 33 wherein said cap and said spout have mating interference structure for holding said spout in said closed position.

35. The dispensing container of claim 33 wherein said tubular closure element and said spout have mating interference structure for holding said spout in said closed position.

36. The dispensing container of claim 33 wherein said compressing member is a protective cover having an inner surface which bears against said spout in said engaged position.

37. The dispensing container of claim 36 wherein said protective cover is hingedly connected to said cap and includes a snap closure element engageable with a snap closure element on said cap.

38. The closure device of claim 33 wherein said static sealing element comprises a removable O-ring held in tension around a portion of said spout.

39. The closure device of claim 38 wherein said dynamic sealing element comprises a removable O-ring held in tension around an outer surface of said tubular closure element.

40. The closure of claim 33 wherein said dynamic sealing element comprises a removable O-ring held in tension around an outer surface of said tubular closure element.

41. The dispensing container of claim 33 wherein said plug member is receivable by said bore during sliding movement of said spout, said plug member further having a cylindrical upper portion which includes said static sealing element thereon and at least one guide member extending from said cylindrical upper portion, said guide member being receivable in said bore and allowing liquid in said receptacle portion to flow through said bore when said spout is in an open position.

* * * * *